US005454659A

United States Patent [19]

Vosbikian et al.

[11] Patent Number: 5,454,659

[45] Date of Patent: Oct. 3, 1995

[54] LIQUID DISPENSING IMPLEMENT

[75] Inventors: Peter S. Vosbikian; Paul P. Vosbikian, both of Moorestown, N.J.

[73] Assignee: Quickie Manufacturing Corporation, Cinnaminson, N.J.

[21] Appl. No.: 324,008

[22] Filed: Oct. 14, 1994

[51] Int. Cl.[6] ..... A47L 13/17; A47L 13/03

[52] U.S. Cl. ..... 401/207; 401/37; 401/140

[58] Field of Search ..... 401/207, 140, 401/37

[56] References Cited

U.S. PATENT DOCUMENTS

| | | | |
|---|---|---|---|
| D. 330,788 | 11/1992 | Berti | D32/45 |
| 1,620,801 | 3/1927 | Clark | 401/207 |
| 2,742,660 | 4/1956 | Van Esley | 15/138 |
| 2,820,234 | 1/1958 | Rigney | 15/136 |
| 3,128,493 | 4/1964 | Paul | 15/542 |
| 3,690,779 | 9/1972 | Ellis | 401/207 R |
| 4,008,968 | 2/1977 | Hobbs | 401/207 |
| 4,148,318 | 4/1979 | Meyer | 128/269 |
| 4,826,340 | 5/1989 | Rothweiler et al. | 401/279 |
| 4,875,602 | 10/1989 | Chickering et al. | 222/187 |
| 4,886,388 | 12/1989 | Gulker et al. | 401/148 |
| 4,934,855 | 6/1990 | Recchelbacher | 401/137 |

FOREIGN PATENT DOCUMENTS

| | | | |
|---|---|---|---|
| 748246 | 4/1956 | United Kingdom | 401/207 |
| 2160092 | 12/1985 | United Kingdom | 401/207 |

*Primary Examiner*—Steven A. Bratlie

[57] ABSTRACT

A liquid medium dispensing implement, to be operated by hand, has a hollow handle, forming a reservoir into which a liquid cleaning or other liquid application medium can be filled. A nipple extends from the end of the handle and contains a pinhole opening, through which the liquid flows from the handle reservoir. A separate and detachable sponge applicator snaps onto the end of the handle to form liquid tight seals between the applicator and the outside circumference of the handle, and between the nipple and an opening in the support piece of the applicator into which the nipple is inserted. The implement can be used effectively, cleanly, and without liquid waste for cleaning dishes and pots or for a variety of other applications in which liquid is to be applied to treat a surface.

3 Claims, 6 Drawing Sheets

LIQUID DISPENSING IMPLEMENT

BACKGROUND OF THE INVENTION

Manually operable hand use implements which employ brush and sponge applicators to clean dishes, pots, appliances, and other soiled surfaces, and for use in other liquid surface treatment applications, are varied and well known. Some of these devices have hollow handles which comprise liquid reservoirs. Such reservoirs are filled with liquid cleaner or other liquid medium and are fed by some manner through the handle to the applicators for use. Examples of such devices are found in U.S. Pat. Nos. 2,742,660, 4,826,340, 4,934,855, and U.S. Pat. No. Des. 330,778. However, the configurations and structural features of these devices make them inefficient, subject to wasteful and messy leakage of liquid medium, and are generally cumbersome. Connections between the liquid containing handles and applicators do not provide liquid tight seals. The means to connect the handles to the applicators in many of these devices are slide actuated, which results in increasing opportunity for leakage, both during operation and when implements are not in use and are placed in a resting position on their handles, with applicators in the air. Attempted solutions to these disadvantages and limitations taught by the prior art have heretofore been complex and impractical, both from a use and economic standpoint.

SUMMARY OF INVENTION

It is the object of the present invention to overcome the limitations and disadvantages of prior manually employed hand use implements.

It is the object of the present invention to provide a manual hand use implement with an integral liquid reservoir handle which is efficient, simple and economical in use.

It is a further object of the present invention to provide an implement with an integral liquid reservoir which is used for cleaning and other surface treatment, which is clean and leak-free during operation and storage.

It is another object of the present invention to provide an implement with an integral liquid reservoir which eliminates waste and leakage of liquid medium used.

It is a further object of the present invention to provide an implement having an integral liquid handle reservoir with a unique, simple and effective way to transfer liquid medium from the reservoir to the applicator and ultimately to the surface to be treated, without leakage and waste.

More particularly, the present invention comprises a manually operated implement with a hollow handle forming a reservoir. The reservoir is adapted to be filled with a liquid medium dishwashing cleanser. However, since the use of the implement is not limited to cleaning, other liquid medium, such as wax, polish, water, can be used, depending on the manner of service to which the invention will be put. A projection or nipple extends from the end of the handle and contains a pinhole opening through which the liquid medium flows from the handle. An independent, detachable sponge applicator member is designed and formed to easily snap onto the end of the handle, such that liquid medium tight seals are formed between the outside circumference of the handle and the applicator member and the nipple of the handle and the applicator member.

The novel features which are considered as characteristic of the invention are set forth in particular in the appended claims. The manual implement itself, however, both as to its design, construction, and use, together with additional features and advantages thereof, are best understood upon review of the following detailed description with reference to the accompanying drawings.

FIB. 18 is a side elevation view of the implement in its assembled and operational state.

Figure 19:
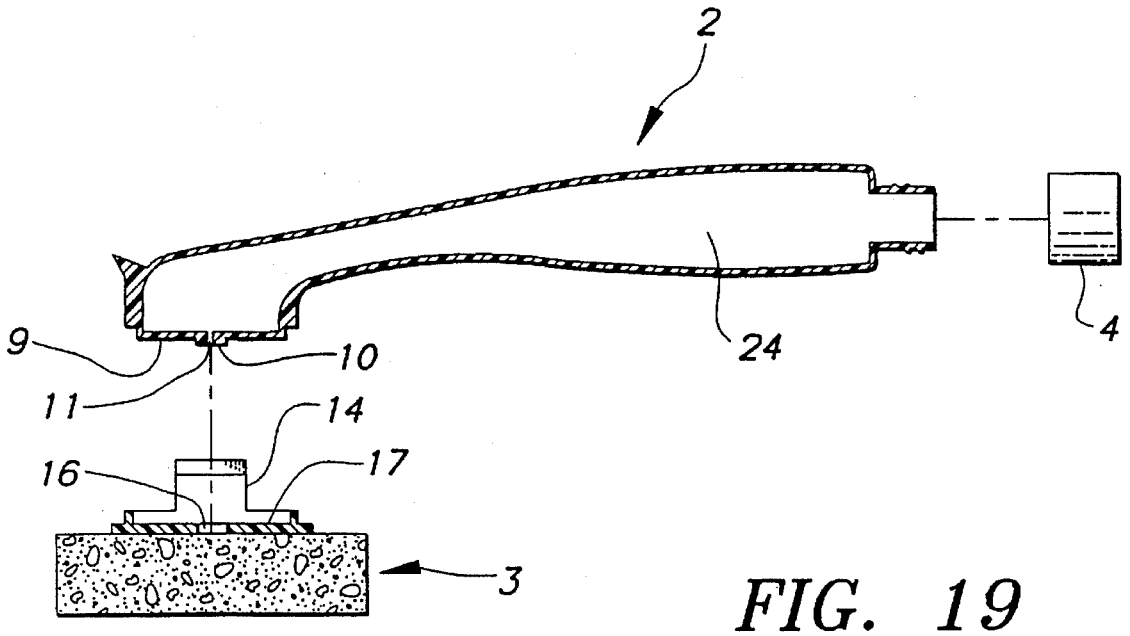

FIG. 19 is an elevational cross-section of the implement, with its separable components apart, but lined up for attachment.

Figure 20:
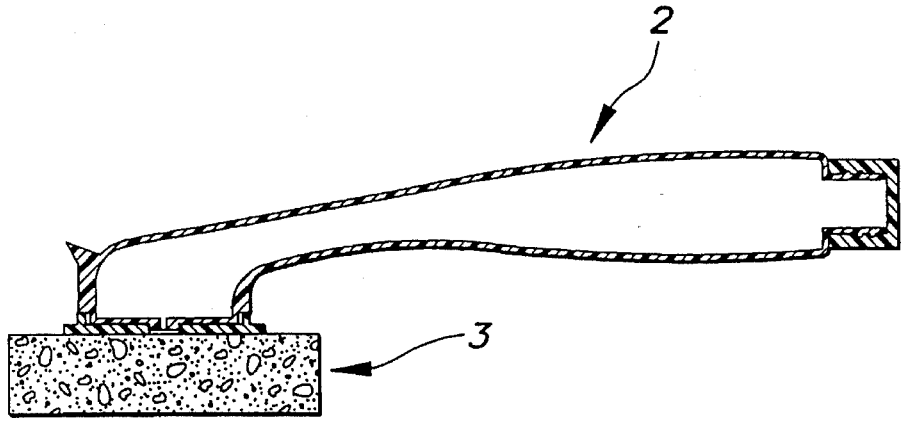

FIG. 20 is an elevational cross-section of the implement in its assembled and operational state.

DETAILED DESCRIPTION OF THE INVENTION

Implement 1 consists of two basic separable components, handle 2 and applicator member 3. Handle 2 is advantageously configured to be comfortably grasped at its extended portion 25 for hand use. As best seen in FIGS. 19 and 20, handle 2 is hollow, forming a reservoir 24 for the placement of a liquid medium. The end of handle 2 is open at 23. Liquid filler cap 4 is attached to and closes off the end of handle 2 by means of a threaded connection 5. The other end of handle 2 is formed by an outer body portion 21 and an inner body portion 22. The underside of the inner body portion 22 consists of an enclosed bottom surface 9. Integral with but projecting from the surface is a nipple 10. At the end of the nipple there is a pinhole opening 11, which connects through to the handle reservoir 24, as best seen in FIG. 19.

Outer portion 21 surrounds inner portion 22, except for two recessed spaces 6 and 7. Undersurface 12 is located on the bottom of outer portion 21. Scrapper component 8 is mounted on outer portion 21 on the front of the handle.

Figure 6:
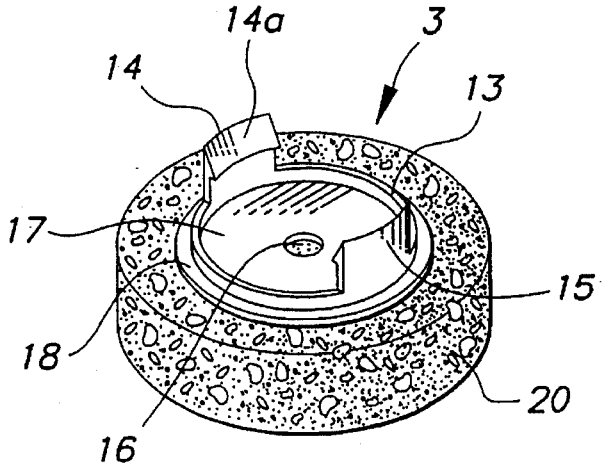
FIG. 6 is a perspective view of the applicator member.
Figure 7:
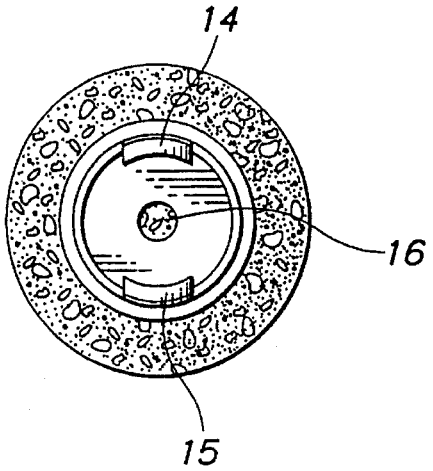
FIG. 7 is a top plan view of the applicator member.
Figure 8:
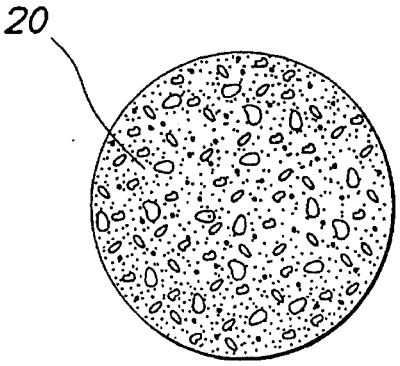
FIG. 8 is a bottom plan view of the applicator member.
Figure 9:
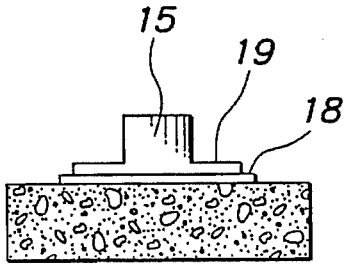
FIG. 9 is a side elevation view of the applicator member.
Figure 10:
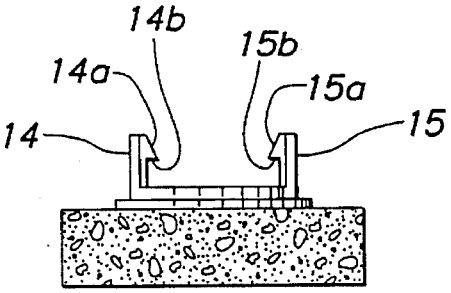
FIG. 10 is a front elevation view of the applicator member.
Figure 11:
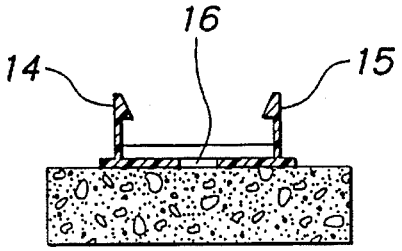
FIG. 11 is a cross-section of the FIG. 10 view of the applicator member.
Figure 12:
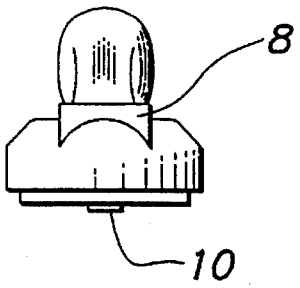
FIG. 12 is a front elevation view of the handle member.
Figure 13:
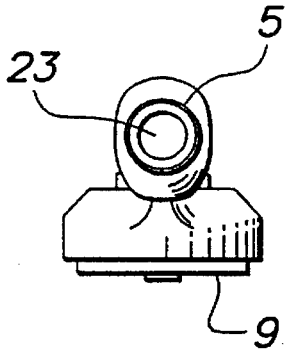
FIG. 13 is a rear elevation view of the handle member with its filler cap removed.
Figure 14:
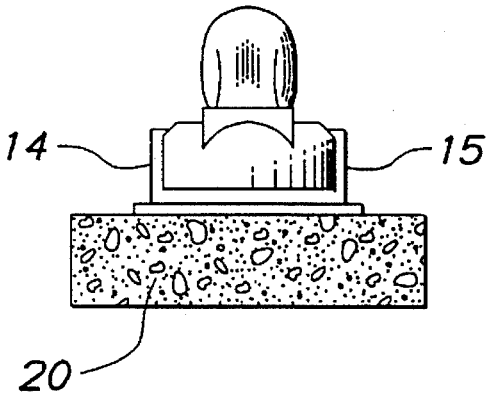
FIG. 14 is a front elevation view of the implement with handle member and applicator member attached.
Figure 15:
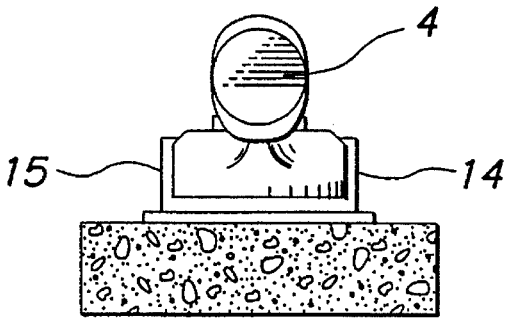
FIG. 15 is a rear elevation view of the implement with handle member and applicator member attached and filler cap in place.
Figure 16:
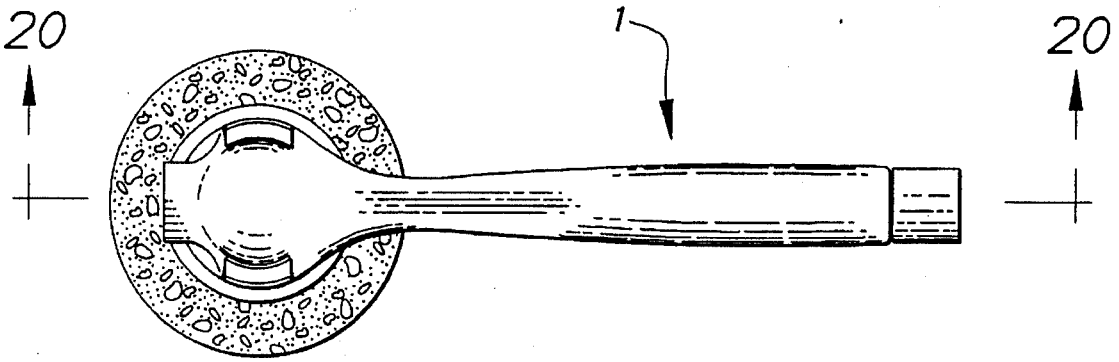
FIG. 16 is a top plan view of the implement in its assembled and operational state.
Figure 17:
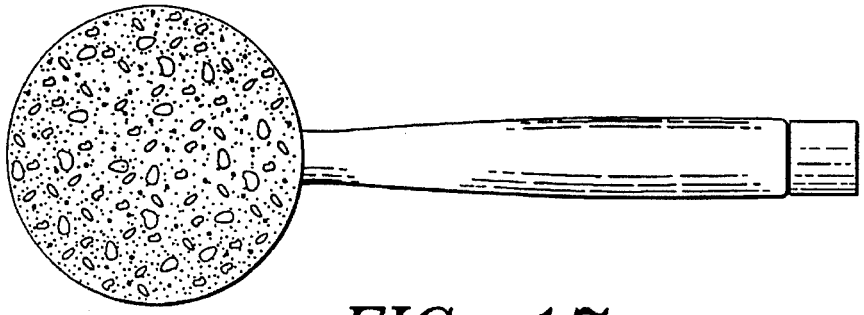
FIG. 17 is a bottom plan view of the implement in its assembled and operational state.
Figure 18:
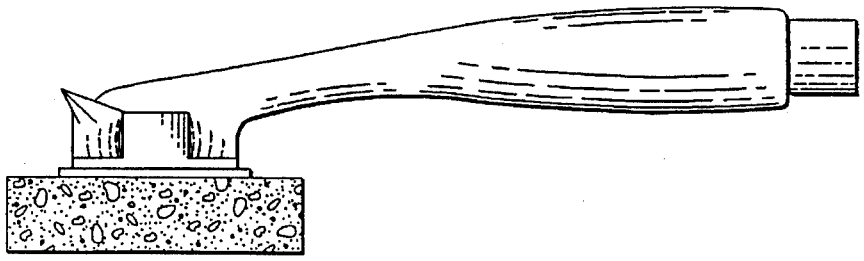

The applicator member 3 shown in FIG. 6 consists of support piece 13 and liquid applicator body 20, which comprises a sponge or like pliable, absorbent material. Applicator body 20 is advantageously circular in shape. Support piece 13 can be lightweight plastic, preferably molded as one integral piece, cemented or otherwise secured to applicator body 20. Support piece 13 comprises two flexible, spring-like upstanding attachment snap arms 14 and 15. Surfaces 14*a* and 15*a* of arms 14 and 15 respectively, are slanted downwardly and inwardly, ultimately forming cantilevered hook surfaces 14*b* and 15*b*. Support piece 13 also is formed with flat inner surface 17, outer edge surface 18, and upper rim surface 19. Opening 16 is located in the center of support piece 13. Opening 16 is dimensioned and sized to receive nipple 10 of handle 2.

Figure 1:
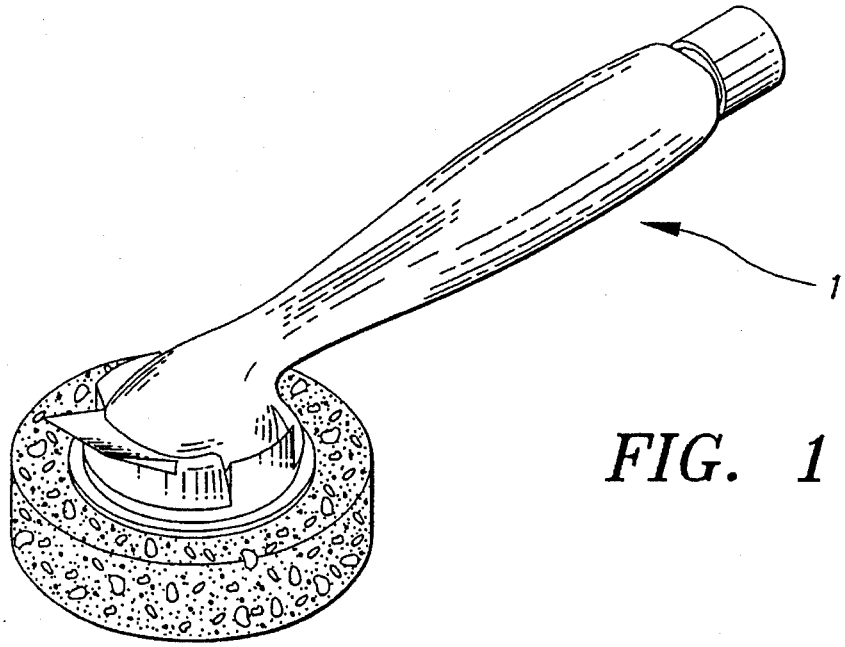
FIG. 1 is a perspective view of the implement in its assembled and operational state.
Figure 2:
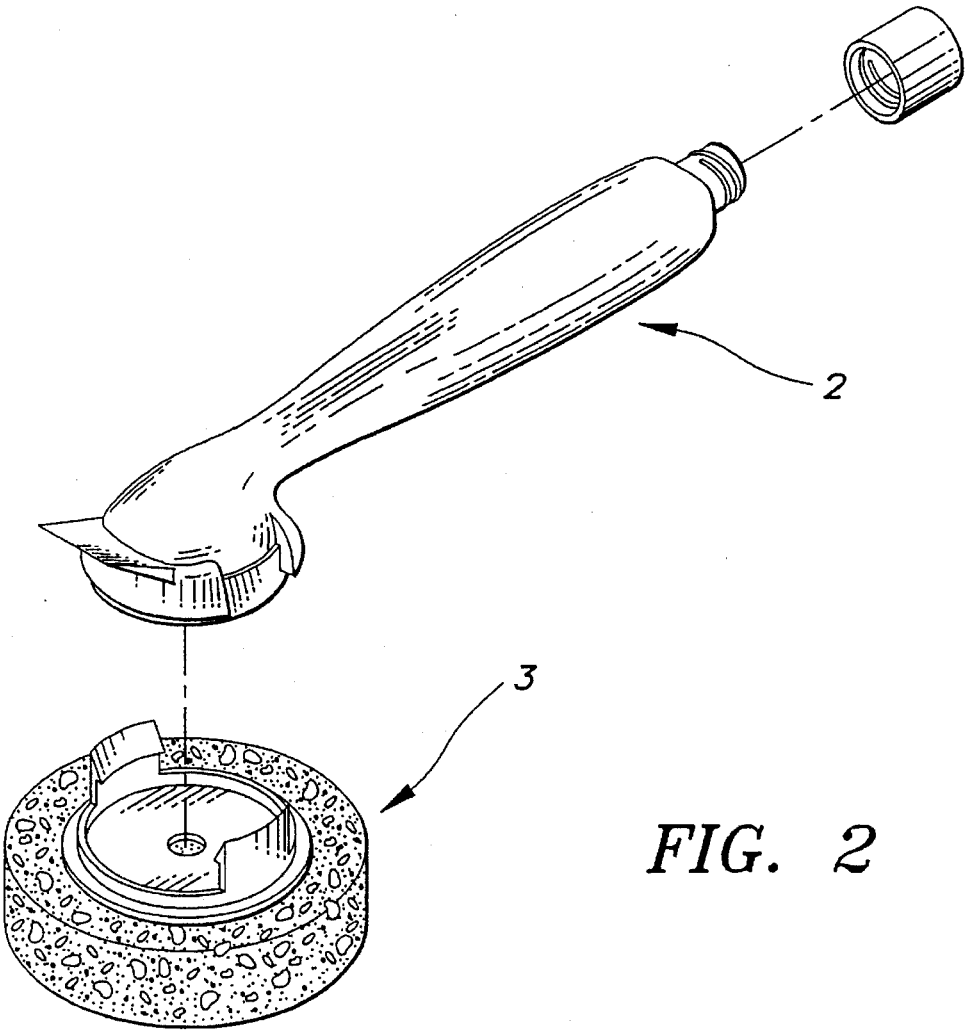
FIG. 2 is a perspective view of the implement, with its separable components apart, but lined up for attachment.
Figure 3:
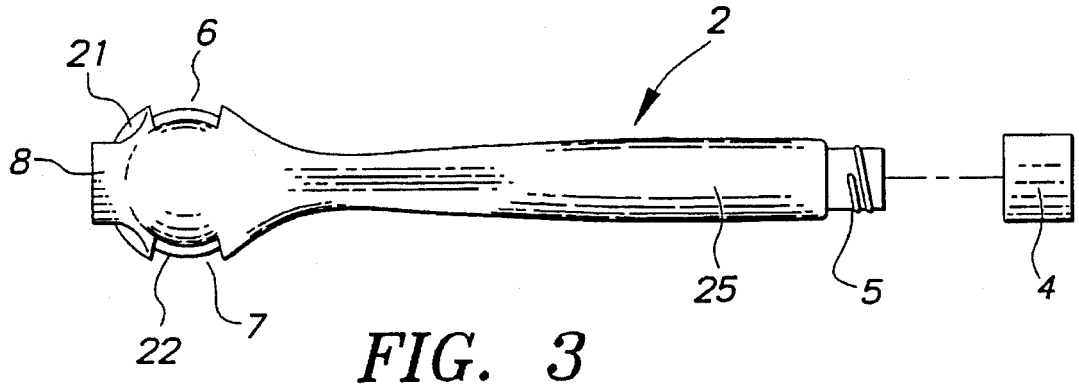
FIG. 3 is a top plan view of the handle member.
Figure 4:
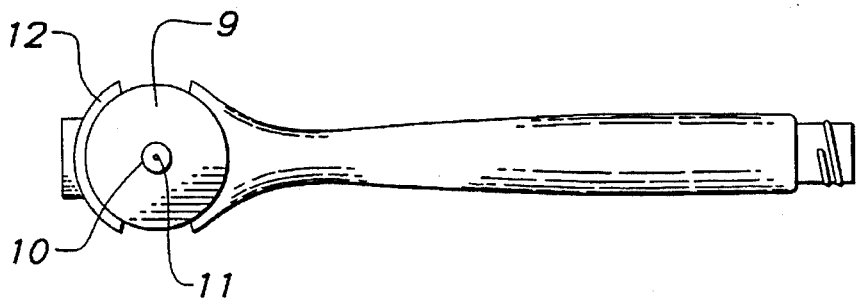
FIG. 4 is a bottom plan view of the handle member.
Figure 5:
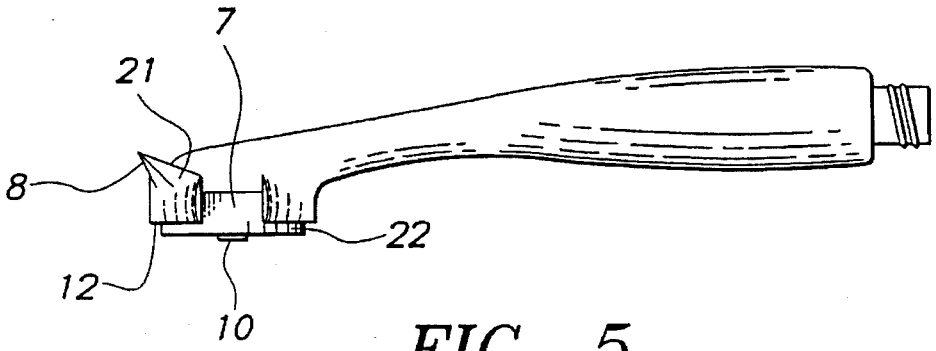
FIG. 5 is a side elevation view of the handle member.

To connect handle 2 to applicator member 3, these two components are positioned, as best shown in FIGS. 2 and 19, with handle bottom surface 9 directly over applicator support piece inner surface 17. Spaces 6 and 7 of the handle are positioned over arms 14 and 15 respectively, and nipple 10 is positioned over opening 16.

Handle 2 is then moved down, snapped, and locked onto applicator number 3 by means of the engagement of arms 14 and 15 into spaces 6 and 7. This is accomplished since the diameter of inner portion 22 is designed to be smaller than the distance between the upper surfaces of 14*a* and 15*a*, but larger than the lower surfaces of 14*a* and 15*a*. As handle 2 is moved toward the applicator member 3, arms surfaces 14*a* and 15*a* contact inner portion 22. Continued movement of inner portion 22 of handle 2 downward towards applicator member inner surface 17, along arm surfaces 14*a* and 15*b*, causes flexible spring-like arms 14 and 15 to be spread outward and press around inner body portion 22 at spaces 6 and 7. At the end of the downward movement of handle 2, bottom surface 9 contacts inner surface 17 and nipple 10 enters opening 16 and is pushed into pliable applicator body 20. Also at this time, arms 14 and 15 are fully ensconced in spaces 6 and 7 and their spring-like nature causes them to snap tight around inner body portion 22.

The force of arms 14 and 15 securing handle 2 in place, causes implement 1 to become a rigid unitary device, locking undersurface 12 of handle 2 to upper rim surface 19 of applicator member 3, and nipple 10 within opening 16. This provides a liquid medium tight seal between surfaces 12 and 19 and around nipple 10 where it enters opening 16.

A liquid medium, such as a liquid wax, dishwashing liquid, or the like is poured into the end of the handle 2 through opening 23 at threaded connection 5. The liquid medium travels through and fills the handle reservoir 24 which is then closed by screwing on filler cap 4.

In use, liquid medium flows from the handle reservoir 24 through nipple 10 and out pinhole opening 11 directly into applicator body 20. Flow is controlled by gravity or the vacuum or sucking force generated by pushing down on applicator body 20 and then allowing it to slowly rise. This design and configuration provides a seal between handle 2 and applicator member 3, preventing liquid medium from flowing other than through pinhole opening 11 into applicator body 20, regardless of the position of implement 1. Even with implement 1 resting on its handle 2 with applicator member 3 in the air, there is no leakage of liquid medium.

Applicator member 3 can be simply separated from handle 2, for cleaning or replacement, by snapping handle 2 off applicator member, e.g. placing a thumb and putting pressure on arm 15, grasping extended handle portion 25, and pulling upward. The handle and applicator member will then snap apart.

Applicator member 3, after being used and having become worn, can be replaced by an identical applicator member and used on the original handle 2. Both handle 2 and applicator member 3 are components which are designed to be interchangeable with identical handles and applicator members.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

What is claimed:

1. A manually operated implement comprising:

a. hollow handle means adapted to receive a liquid medium, said handle means having two distinct ends and further comprising:

(i) liquid medium fill means at the first end of the handle means for receipt of liquid medium into the handle means;

(ii) a second end of the handle means comprising an inner body portion and an outer body portion circumferentially overlaying and outwardly surrounding the inner body portion, the outer body portion having two recessed side spaces, one on each side of the outer body portion; the bottom of the inner body portion of the handle means being a substantially enclosed surface of circular configuration;

(iii) handle projection means integral with and extending out from the bottom of the inner body portion of the handle means, said handle projection means comprising pinhole opening means for the flow of liquid medium completely through the handle projection means; and b. independent applicator member means for snap-on engagement with the handle means, said applicator member means being completely symmetrical in configuration and further comprising:

(i) an applicator element of circular configuration;

(ii) support piece means attached to said applicator element, said support piece means comprising two upstanding spring-like arm means which are inserted and locked into the recessed side spaces in the outer body portion of the second end of the handle means, forming an immoveable liquid medium tight connection between the handle means and the applicator means when the handle means and applicator member means are engaged;

(iii) an opening in the support piece means to receive handle projection means, whereby upon snap-on engagement of the applicator member means to the handle means by the insertion of the arm means into the recessed side spaces in the outer body portion of the second end of the handle means, the handle projection means becomes embedded in the applicator element and a liquid medium tight collection is at all times formed between the handle projection means and the opening in the support piece means, and additionally, whereby upon snap-on engagement of the applicator member means to the handle means, liquid medium flows through pinhole opening means in the handle projection means directly into the applicator element.

2. A manually operated implement as described in claim 1, wherein said handle projection means is of nipple configuration.

3. A manually operated implement as described in claim 1, wherein said outer body portion comprises a scraper at its front end.

* * * * *